US006258186B1

(12) United States Patent
Choi

(10) Patent No.: US 6,258,186 B1
(45) Date of Patent: Jul. 10, 2001

(54) METHOD FOR MANUFACTURING HOT ROLLED GALVANIZED STEEL SHEET AT HIGH SPEED, WITH PICKLING SKIPPED

(75) Inventor: Jin Won Choi, Kyungsangbook-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/473,641

(22) Filed: Dec. 28, 1999

(30) Foreign Application Priority Data

Dec. 29, 1998 (KR) ..... 98-60213
Dec. 29, 1998 (KR) ..... 98-60222

(51) Int. Cl.[7] ..... B05D 3/00
(52) U.S. Cl. ..... 148/533; 148/602
(58) Field of Search ..... 148/533, 602

(56) References Cited

U.S. PATENT DOCUMENTS 4,067,754 * 1/1978 Elias et al. ..... 148/533
4,544,419 * 10/1985 Irie et al. ..... 149/533

FOREIGN PATENT DOCUMENTS 6056418 12/1985 (JP) .
05156416 6/1993 (JP) .
06145937 5/1994 (JP) .
0041446 6/1999 (KR) .
0041447 6/1999 (KR) .

* cited by examiner

*Primary Examiner*—George Wyszomierski
(74) *Attorney, Agent, or Firm*—Webb Ziesenheim Logsdon Orkin & Hanson, P.C.

(57) ABSTRACT

A method for manufacturing a hot rolled galvanized steel sheet at a high speed, with the pickling skipped, is disclosed, in which an intermediate rapid cooling is carried out at a predetermined temperature so as to make the wüstite component of the scales become 20% or more after a hot rolling, then a reducing heat-treatment is carried out, and then the steel sheet is dipped into a zinc bath containing a predetermined amount of Al, thereby realizing a superior coating adherence and a superior productivity. The hot rolled steel sheet is cooled at a usual cooling rate, and is coiled. Then an intermediate rapid cooling is carried out on the hot rolled steel sheet (thus coiled) to an intermediate rapid cooling temperature of 300–500° C. so as to make a wüstite component of scales become 20% or more. Then a reducing heat treatment is carried out at a temperature of 550–700° C. for 30–300 seconds under a 20% (or more) hydrogen atmosphere. Then the hot rolled steel sheet (thus reduced) is dipped into a zinc bath having an Al concentration of 0.2–5.0 wt %, whereby a superior coating adherence and a superior productivity are realized.

8 Claims, 6 Drawing Sheets

Reducing Temperature: 650°C Soaking Time: 250 seconds
Controlled Cooling rate: 20°C/sec Al Content: 0.2 wt%, 1000magnification

| Grade | ○ | △ | × |
|---|---|---|---|
| Peela-bility | No Peeling | Partly Peeling | Complete Peeling |
| Appea-rance 1 | | | |
| Appea-rance 2 | | | |

Appearance1 : 180° Bending → Taping Test

Appearance2 : 180° Bending

Reducing Temperature: 650°C Soaking Time: 250 seconds
Controlled Cooling rate: 20°C/sec Al Content: 0.2 wt%, 1000magnification

METHOD FOR MANUFACTURING HOT ROLLED GALVANIZED STEEL SHEET AT HIGH SPEED, WITH PICKLING SKIPPED

FIELD OF THE INVENTION

The present invention relates to a method for manufacturing hot rolled galvanized steel sheet at high speed, wherein the pickling step is skipped. More specifically, the present invention relates to a method for manufacturing a hot rolled galvanized steel sheet, in which a controlled intermediate rapid cooling is carried out so as to make the w üstite proportion of the surface scales become 20% or more, and the scale layer is reduced, thereby realizing a high coating adherence and superior productivity.

BACKGROUND OF THE INVENTION

The conventional method for manufacturing hot rolled galvanized steel sheet is carried out in the following manner. After hot rolling, the hot rolled steel sheet is pickled and then zinc-hot-dip-coated, so that a level of corrosion resistance better than pickled and oiled steel sheet can be obtained, thereby improving the value-added factor. FIG. 1*a* illustrates a conventional process for manufacturing hot rolled steel sheet with a pickling stop present.

Generally in manufacturing hot rolled steel sheet, scales (referred to as "secondary scales") are formed on the surface of the steel sheet after a rough rolling step during the hot rolling, process. These secondary scales include: a hematite layer as an outermost layer contacting atmospheric air; a magnetite layer just under the hematite layer toward the matrix structure; and a wüstite layer closely contacting the matrix structure, the thickness being about 10 $\mu$m. These secondary scales greatly deteriorate the coating adherence of the hot rolled galvanized steel sheet, and therefore, the scales are removed by using a pickling solution in which a chloric acid or sulfuric acid solution and a corrosion inhibiting agent are mixed together. However, an oxide layer of about 100–570 Å remains on the surface of the pickled hot rolled steel sheet, and therefore, the zinic coating adherence is significantly aggravated. Therefore, the pickled hot rolled steel sheet is heated to 480–500° C. under an atmosphere of a 7–15%-hydrogen concentration to reduce the oxide layer based on the mechanics of Formulas 1–3 as shown below, and then, a hot dipping is carried out in a zinc bath.

$$3Fe_2O_3+H_2 \rightarrow 2Fe_3O_4+H_2O \quad (1)$$

$$Fe_3O_4+H_2 \rightarrow 3FeO+H_2O \quad (2)$$

$$FeO+H_2 \rightarrow Fe+H_2O \quad (3)$$

However, when the scale layer is removed by a pickling, there are generated great differences on a reaction kinetics according to the compositions of the scale layers. Therefore, a part of the matrix structure is over-pickled, and therefore, the surface of the steel sheet becomes rough and irregular, with the result that problems of hydrogen brittleness, iron loss and acid loss can be generated. Further, the pickling has to be completed within a short period of time, and therefore, the operating managements such as the heating condition management, the acid concentration management and the corrosion inhibiting agent concentration management cannot be easily carried out.

Further, a strongly toxic and highly corrosive agent such as a chloric acid solution and a sulfuric acid solution is used. Therefore, a waste acidic solution treating facility have to be installed and maintained, and therefore, the manufacturing cost is increased, while the environmental contamination can become serious.

Further, if the Si content of the steel is 0.1 wt % or more, then the coating adherence is markedly aggravated in the hot rolled galvanized steel sheet. To describe it specifically, if a hot rolled steel sheet contains 0.1 wt % or more of Si which is the coating-fastidious element, there is formed fayalite ($2FeO.SiO_2$) on the boundary between the scale layer and the matrix structure. This fayalite ($2FeO.SiO_2$) remains without being removed even after the pickling, thereby forming a non-coated layer. Even if the coating is done, the coating adherence is degraded, thereby inviting later peeling. Thus, a scale layer remains which is not removed by pickling, and the scale layer is not removed even during the subsequent reducing process.

In an attempt to overcome these problems, Japanese Patent Laid-open No. Sho-60-56418 and Hei-5-156416 disclose a method in which the steel sheet is electroplated with Fe, Ni, Cu, Fe—Mn or the like before carrying out the zinc hot dipping. By electroplating the steel sheet, the alloy elements are concentrated on the boundary of the matrix structure when carrying out a high temperature annealing. However, the alloy elements are concentrated under the electroplated layer, and therefore, the alloy elements cannot react with the atmospheric gas, and, therefore, cannot be oxidized. Therefore, in the case where a pickled steel sheet having a rough matrix structure surface is subjected to a hot rolled galvanizing process, a problem occurs in that the amount of coating on the depressed surface is irregular due to the short coating time period. In order to avoid this problem, the electroplating time period is extended or the operation is slowed. However, in this manner, although the non-coating of the depressed portions can be solved, the over-coating of the projected portions cannot be solved. Further, the pre-coated alloy elements have a high hardness and a low ductility, and therefore, if the pre-coated thickness is thick, it will be peeled off later.

In another method as shown in FIG. 1*b,* a flux treatment is conducted using zinc chloride ($ZnCl_2$) and ammonium chloride ($NH_4Cl$) after completion of the pickling step, thereby providing a discontinuous zinc hot dipping process. In this method, the procedure is complicated, and therefore, the economy is inadequate, as well as being harmful to the environment.

In order to solve the above described problems, methods have been proposed for manufacturing a hot rolled galvanized steel sheet, in which the pickling step is skipped, as shown schematically in FIG. 1*c*. One example of such is a process disclosed Japanese Patent Laid-open No. Hei-6-145937. In this method, the pickling step is skipped, and the scales are reduced under a reducing atmosphere at a temperature of 300–750° C. This method is effective in solving the above described problems. However, after the hot rolling, the scales consist of 87% magnetite, 6% of wüstite and 7% hematite. Therefore, if the magnetite as the major component of the scales is to be reduced, the reduction has to be carried out at a temperature of 650–820° C. for 300 seconds or more. Due to such a long reduction period, the productivity cannot be improved. Further, in this method, if the hot rolled steel sheet is a coating-fastidious steel sheet containing 0.1% or more of Si, a superior coating adherence cannot be ensured like in the other methods which include the pickling step.

Other examples in which the pickling step is skipped, are found in Korean Patent Application Nos. 97-62031 and 97-62032 of the present inventor. In these methods, the temperature and the reducing gas concentration are properly controlled at the reducing and heating zone, and the Al concentration in the zinc bath is optimized, thereby improving the coating adherence. However, in these methods, the scales also contain about 90% magnetite, and therefore, a long time period is required for reducing the magnetite. Thus a fast reduction cannot be expected, and therefore, the productivity cannot be improved.

SUMMARY OF THE INVENTION

The present invention is intended to overcome the above described disadvantages of the conventional techniques.

The present invention provides a method for manufacturing a hot rolled galvanized steel sheet at a high speed, with the pickling step skipped, in which an intermediate rapid cooling is carried out at a predetermined temperature so as to make the wüstite component of the scales become 20% or more after a hot rolling. A reducing heat-treatment is then carried out, and then the steel sheet is dipped into a zinc bath containing a predetermined content of Al, thereby realizing superior coating adherence and superior productivity.

The present invention further provides method for manufacturing a hot rolled galvanized steel sheet at a high speed, with the pickling step skipped, in which in coating a steel sheet containing 0.1 wt % or more of Si, an intermediate rapid cooling is carried out at a predetermined temperature so as to make the wüstite component of the scales become 20% or more after a hot rolling. A reducing heat-treatment is then carried out, and then the steel sheet is dipped into a zinc bath containing a predetermined content of Al, thereby realizing superior coating adherence and superior productivity.

In achieving the above objects, the method for manufacturing a hot rolled galvanized steel sheet at a high speed, with no pickling, according to the present invention includes the steps of: cooling a hot rolled steel sheet at a usual cooling rate, and coiling it; carrying out an intermediate rapid cooling on the hot rolled steel sheet (thus coiled) to an intermediate rapid cooling temperature of 300–500° C. so as to make a wüstite component of scales become 20% or more; carrying out a reducing heat-treatment at a temperature of 550–700° C. for 30–300 seconds under a 20% (or more) hydrogen atmosphere; and dipping the hot rolled steel sheet (thus reduced) into a zinc bath having an Al content of 0.2–5.0 wt %, whereby superior coating adherence and superior productivity are realized.

In another aspect of the present invention, the method for manufacturing a hot rolled galvanized steel sheet at a high speed, with the pickling step skipped and with 0.1 wt % or more of Si contained therein, according to the present invention includes the steps of: cooling a hot rolled steel sheet at a usual cooling rate, and coiling it; carrying out an intermediate rapid cooling on the hot rolled steel sheet (thus coiled) to an intermediate rapid cooling temperature of 300–500° C. so as to make a wüstite component of scales become 20% or more; carrying out a reducing heat treatment at a temperature of 650–750° C. for 60–400 seconds under a 30% (or more) hydrogen atmosphere; and dipping the hot rolled steel sheet (thus reduced) into a zinc bath having an Al content of 0.2–5.0 wt %, whereby superior coating adherence and superior productivity are realized.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

In the conventional hot rolled galvanized steel sheet manufacturing method in which the picking step is skipped, a hot rolled steel sheet which has been coiled at a high temperature is naturally cooled by air down to the room temperature. During the cooling, scales are formed on the surface of the steel sheet. That is, during the natural cooling, the wüstite component of the scale composition is transformed into magnetite, with the result that the final scale composition contains more than 90% magnetite. Magnetite is an oxide which is not easily reduced, compared with w üstite. Accordingly, if this hot rolled steel sheet with the above scale composition is left under a hydrogen reducing atmosphere at a temperature of above 600° C., the reduction of the scales require a long time period due to the long transformation period from magnetite to wüstite, and therefore, superior productivity cannot be expected. The present invention is intended to solve this problem, and its principal feature is that an intermediate rapid cooling is conducted so as to make the wüstite component of the scale composition become 20% or more.

That is, in the present invention, after the hot rolling, the cooling rate on the run-out table is maintained at the normal level, while the hot rolled steel sheet is coiled at a temperature of above 570° C. which is the stable level for the wüstite oxide, the wüstite oxide showing the fastest reducing speed. Then the hot rolled steel sheet is subjected to an intermediate rapid cooling to a temperature of 300–500° C. which is the suitable level for the fastest transformation of magnetite, and which is below the eutectoid transformation temperature of wüstite. Thus a control is carried out such that the wüstite component of the scale composition should become 20% or more.

Figure 1A:
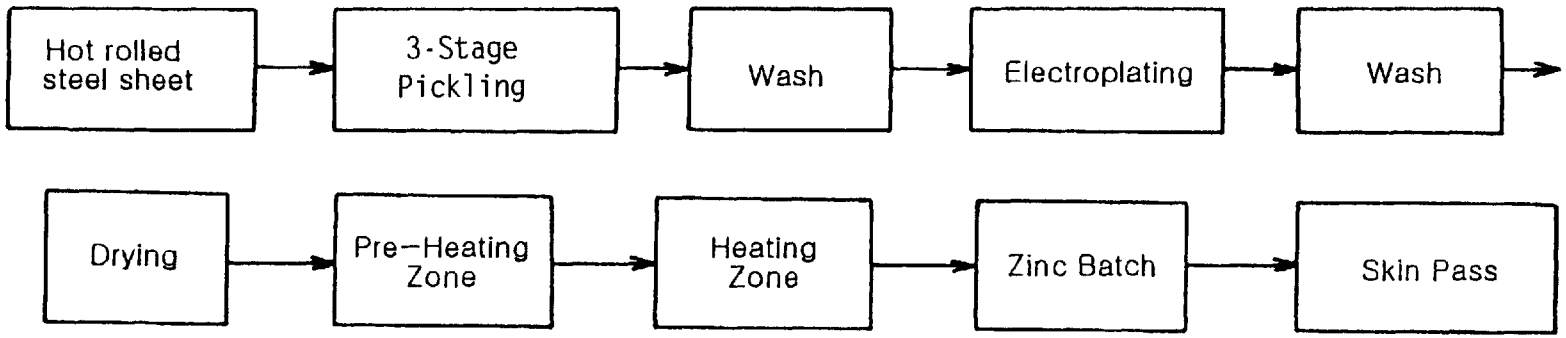
FIG. 1(a) PRIOR ART
FIGS. 1*a*, 1*b* and 1*c* schematically illustrate conventional manufacturing processes for hot rolled galvanized steel sheet.
Figure 1B:
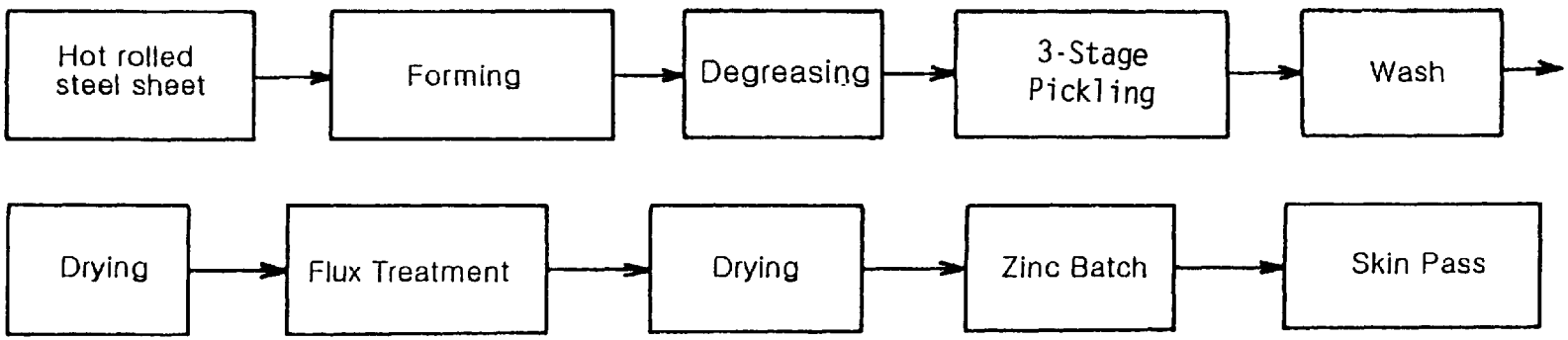
FIG. 1(b) PRIOR ART
Figure 1C:
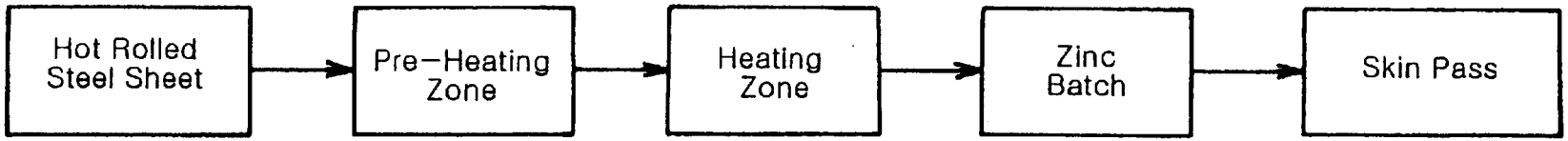
FIG. 1(c) PRIOR ART
Figure 2:
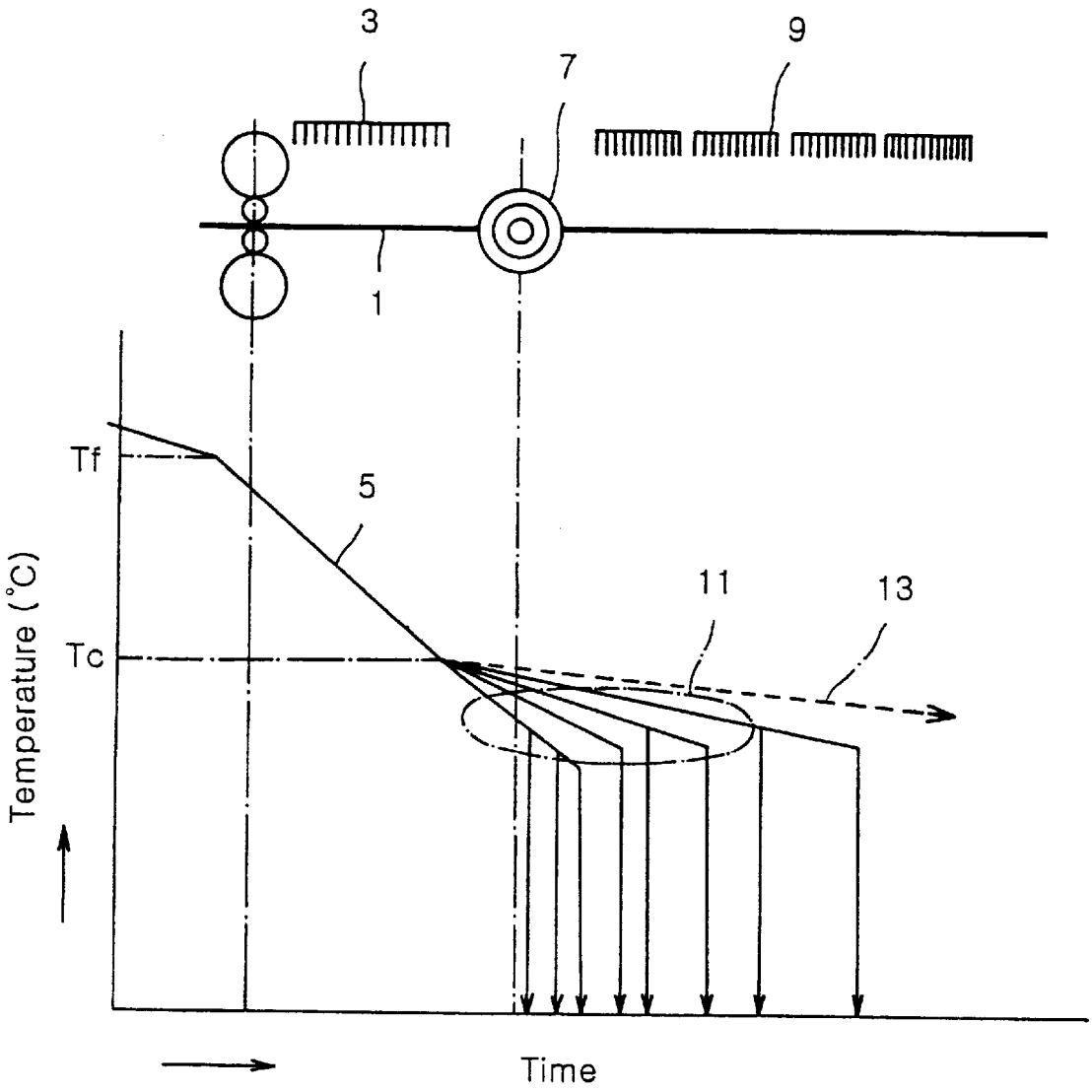
FIG. 2 graphically illustrates the intermediate rapid cooling process for controlling the scale composition according to the present invention, in comparison with the conventional methods.

As shown in FIG. 2, a hot rolled steel sheet 1 which is hot rolled at a finishing delivery temperature $T_f$ is cooled at a usual cooling rate 5 on a run-out table 3, and is coiled by a coiler 7 at a coiling temperature $T_c$. Here, the hot rolled coil is cooled by air in the conventional method 13, while in the present invention 11, an intermediate rapid cooling is carried out on the hot rolled coil at a temperature of 300–500° C. by using an intermediate cooling apparatus. Thus the wüstite component of the scale composition is controlled to become 20% or more. The reason why the wüstite component should become 20% or more will be described below. That is, the hot rolled steel sheet which has been cooled down to the room temperature after the intermediate rapid cooling is heated again to 570° C. or above in order to reduce the scales on the hot rolled steel sheet. During this process, if the w üstite component is less than 20%, when the reheating is carried out to 570° C. or above, the rate at which the eutectic structure of the iron and the magnetite is reduced by the hydrogen gas is larger than the rate at which they are transformed into wüstite. Therefore, the time for reducing the scales cannot be shortened, and therefore, superior productivity cannot be expected.

Meanwhile, the intermediate rapid cooling rate should be preferably 10–300° C./min. The reason why this should be so will be described. If the rapid cooling rate is less than 10° C./min, the wüstite is transformed into the magnetite during the cooling, and therefore, 20% or more of the wüstite component cannot be secured. On the other hand, if the cooling rate exceeds 300° C./min, then wüstite is desirably formed by more than 20%, but a scale peeling is liable to occur due to the thermal strain during cooling.

The hot rolled steel sheet having the above described scale composition may be reduced by reheating after carrying out the rapid cooling. Or it may be directly reduced at a reducing zone.

The temperature for reduction at the reducing zone should be preferably 550–700° C. The reason will be described. That is, if the temperature is below 550° C., a long time heat-treatment is required for securing superior coating adherence, thereby lowering the productivity. If it is above 700° C., then the tensile strength of the hot rolled steel sheet is lowered. The hydrogen concentration in the reducing zone should be preferably 20% or more. If it is less than 20%, the hydrogen as the main medium for the reduction reaction will be insufficient, and therefore, the reduction reaction cannot be efficiently carried out. Further, under the above mentioned heat treating temperature and hydrogen concentration, the heat treating time should be preferably 30–300 seconds. If it is less than 30 seconds, the reduction reaction occurs slowly, thereby making it difficult to obtain the intended coating adherence. If it exceeds 300 seconds, the steel sheet is softened.

Meanwhile, a steel sheet containing more than 0.1 wt % of Si will have a hot rolling scale 10–30% thicker compared with a steel sheet containing less than 0.1 wt % of Si. Further, if the Si content is more than 0.1 wt %, then a process compound (i.e., fayalite) is formed. As a result, the boundary adherence is improved between the matrix structure and the hot rolling scales, and therefore, the free movements of the reducing gas ions is inhibited. Therefore, in the hot rolled steel sheet containing more than 0.1 wt % of Si, the scale reduction is not easy compared with the hot rolled steel sheet containing less than 0.1% of Si. Therefore, a long time has to be consumed in carrying out the reduction at the reducing zone. For this reason, in the present invention, the reducing time is shortened as far as possible. Thus in order to prevent the variations of the mechanical properties of the coated steel sheet, the reducing heat treatment conditions should be preferably limited to a temperature range of 600–750° C., a hydrogen concentration of 30%, and a treating time of 60–400 seconds.

The hot rolled steel sheet which has been reduced in the above described manner is dipped into a zinc bath. Al which is added into the zinc bath improves the gloss, and reduces the oxides within the zinc bath. Further, the Al addition inhibits the formation of the brittle Fe—Zn compound which is liable to be formed on the boundary of the coated layer, thereby improving the coating adherence and the corrosion resistance. To describe it more specifically, Al has an affinity for Fe which is greater than it's affinity for Zn, and therefore, Al rapidly forms a thin compound film on the surface of the steel sheet. The thin film consists of a mixture of an Fe—Al compound ($Fe_2Al_5$) and an Fe—Zn—Al compound. At an Al concentration of 0.1–4.0 wt %, the $Fe_2Al_5$ compound is formed in a short period of time, while at an Al concentration of 4.0–5.0 wt %, a thick Fe—Al compound ($FeAl_3$) is formed in an early stage. The $FeAl_3$ layer is brittle, but the $Fe_2Al_5$ layer lies under the $FeAl_3$ layer so as to provide protection.

Thus, Al which is added into the zinc bath forms a highly ductile Fe—Zn—Al compound in the cracks and pores of the scale layer. This compound serves as an anchor between the scale layer and the matrix structure, thereby improving the coating adherence. In the case where the hot rolled steel sheet contains 0.1 wt % or more of Si (which is a coating-fastidious element), the scale layer on the hot rolled steel sheet becomes porous. In this context, when coating this hot rolled steel sheet, the sponge-like pores and tunnels are filled with the molten Al. Therefore, the molten Al reacts with the fayalite compounds which are present on the boundary between the scale layer and the matrix structure, so as to form Fe—Al—Zn—Si compounds, thereby improving the coating adherence.

In view of the above fact, the Al content within the zinc bath should be preferably limited to 0.2–5.0 wt % in the present invention. To cite the reason, if Al is less than 0.2 wt %, the formation of the Fe—Zn compound on the steel sheet cannot be sufficiently inhibited by Al, and therefore, the coating adherence and the corrosion resistance cannot be improved. On the other hand, if the Al content exceeds 5.0 wt %, then the economy is aggravated.

It is more preferable to limit the Al content to 0.3–5.0 wt % in order to ensure a high coating adherence and an expansion of the reducing heat-treatment range.

As described above, in the present invention, the scale composition of the hot rolled steel sheet is controlled such that the more easily reduced wüstite component becomes 20% or more. In this manner, the reducing heat treatment time can be shortened. Further, in the present invention, Al is added into the zinc bath in a proper amount, so that the Fe—Zn—Al compounds can be selectively formed on the scale layer and on the matrix structure, or that the Fe—Zn—Al—Si compounds can be formed (in the case of Si containing steel sheet), thereby improving the coating adherence and the productivity.

Now the present invention will be described based on actual examples.

EXAMPLE 1

In order to manufacture the hot rolled galvanized steel sheets, steel sheets were hot rolled, and one of the hot rolled steel sheets was cooled in atmospheric air in the usual manner, while the other ones were subjected to an intermediate rapid cooling at a cooling rate of 30–100° C./min down to a temperature of 300–470° C. Then the compositions of the scales of the respective hot rolled steel sheets were measured by using an X-ray diffractometer (made by Rigaku company), and the measured results are shown in Table 1 below. After the measurements, the hot rolled steel sheets were subjected to a reducing heat-treatment at 650° C. under a 20%-hydrogen atmosphere for 120 seconds within a reducing furnace. Then the time periods by which the scales of the hot rolled steel sheets were reduced to a 60%-pure iron are shown in Table 1 below.

As can be seen in Table 1 below, in the case of the conventional example 1, the hot rolled steel sheet was naturally air-cooled, and therefore, the wüstite component (FeO) of the scale composition was 6.1 wt %. Therefore, the time period which was consumed in carrying out the reduction was as long as 250 seconds. In contrast to this, in the cases of the inventive examples 1–4, the scale composition was controlled so as to contain 20 wt % or more of wüstite, and therefore, the scale reducing time periods were decreased significantly. Accordingly the productivity was improved, and thus, it witnesses to the fact that a high speed hot rolled galvanized steel sheet manufacturing method without pickling process could be carried out.

EXAMPLE 2

Figure 3:
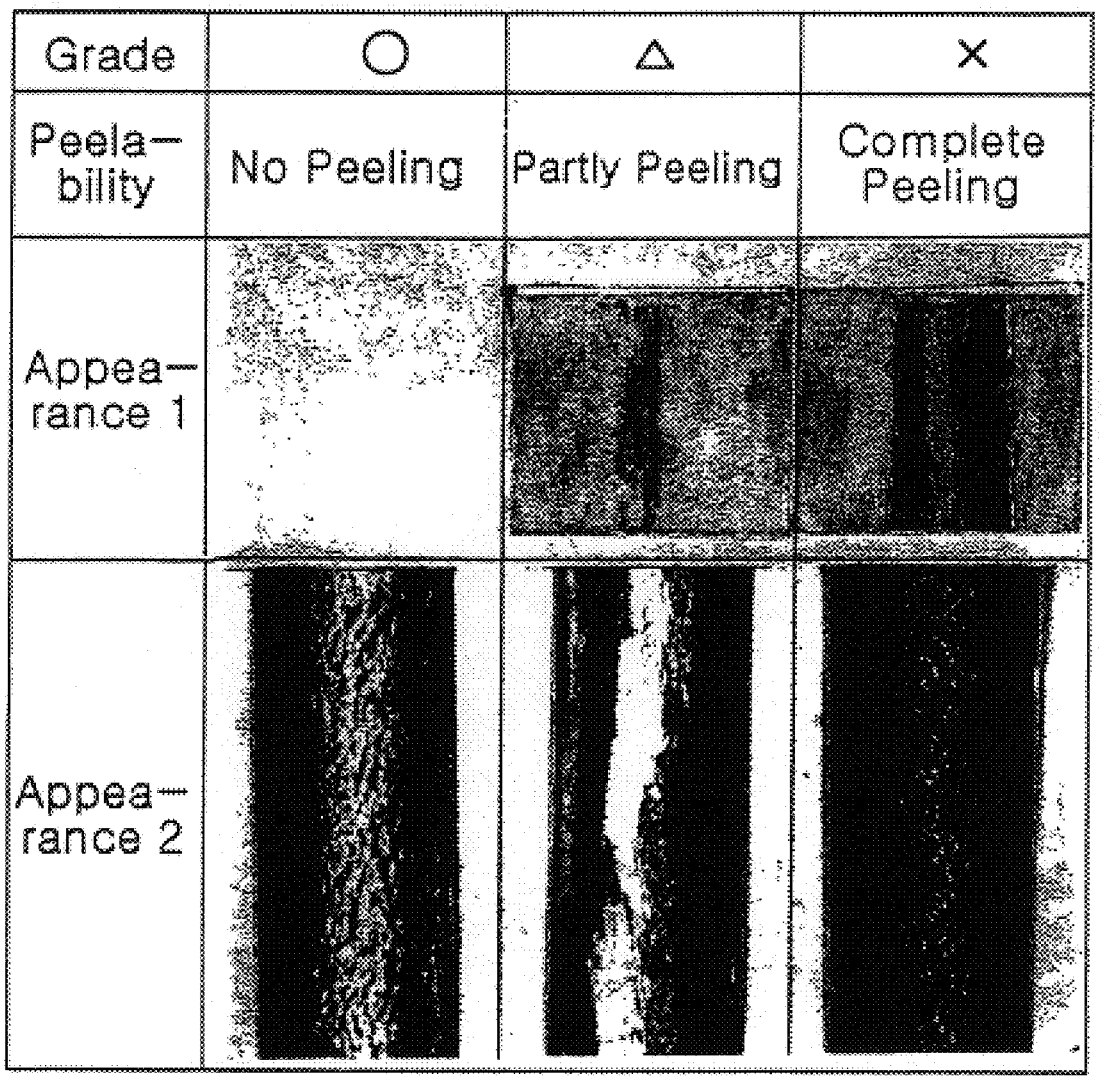
FIG. 3 illustrates the results of the 180° bending tests for evaluating the coating adherence of the hot rolled galvanized steel sheet.

In order to manufacture the hot rolled galvanized steel sheets according to the present invention, steel sheets were hot rolled, and the hot rolled steel sheets were coiled. Then the steel sheets were subjected to an intermediate rapid cooling at a cooling rate of 20–30° C./min down to a temperature of 200–500° C. Then the wüstite components of the scale compositions were measured by using an X-ray diffractometer. Then the steel sheets were cut into a size of 100 mm×200 mm, and a degreasing was carried out. Then by using a coating simulator (made by Rhesca company), the scales were reduced for 60–240 seconds while maintaining the steel sheets under a hydrogen concentration of 20–30% and at a reducing heat-treatment temperature of 550–750° C. The respective scale-reduced steel sheets were dipped into a zinc bath at 450° C. while varying the Al addition amounts. Then the coating adherences were measured, and the results are shown in Table 2 below. In order to measure the coating adherence, the 180° bending tests were carried out by using a bending device. Then tapes were attached and removed by pulling them, and thus the peelability degrees of the coated layers were measured as shown in FIG. 3. As can be seen in FIG. 3, X indicates complete peeling, Δ indicates partial peeling, and 0 indicates good adherence.

Figure 4:
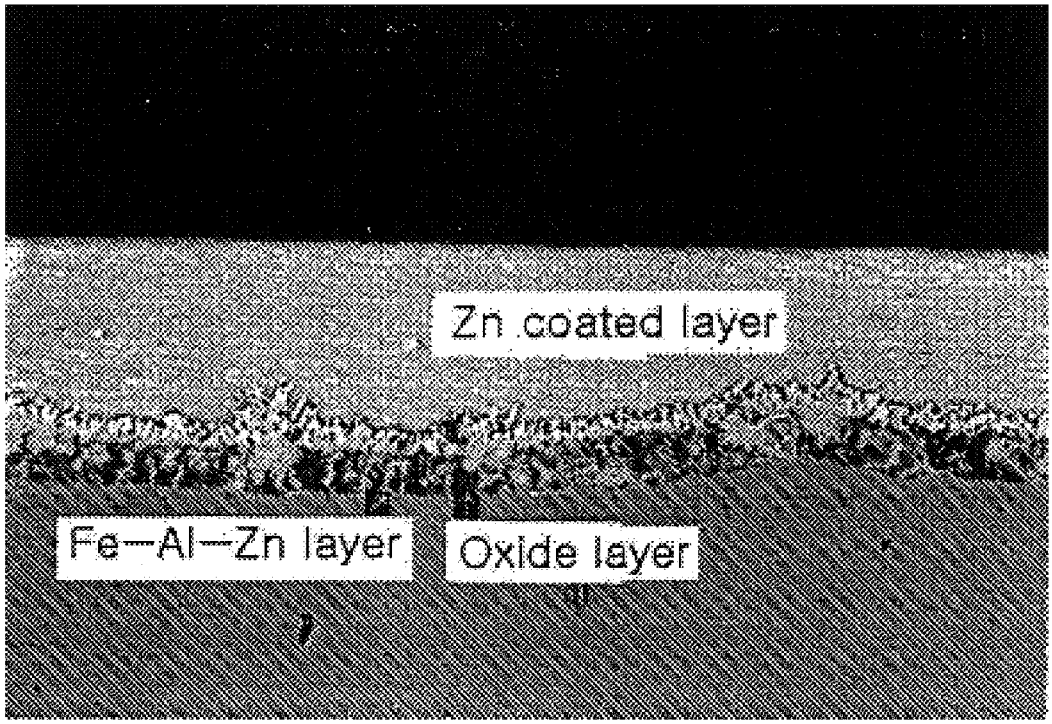
FIG. 4 is a Photomicrograph at 1000× magnification showing the microstructure of the coating layer of the hot rolled galvanized steel sheet manufactured by the present invention.

As shown in Table 2 below, in the cases of the inventive examples 1–17, the steel sheets in which the scale composition was controlled so as to contain 20% or more wüstite were dipped into a zinc bath in which 0.2–5.0 wt % of Al was added. In these examples, not only the productivity but also the coating adherence were superior. As shown in FIG. 4, the superior coating adherence was obtained based on the following principle. That is, the highly ductile Fe—Zn—Al compounds filled the cracks and pores of the scale layer, and these compounds served as an anchor between the scale layer and the matrix structure.

In the case of comparative example 1, the coating adherence was adequate, but the reducing temperature was as high as 750° C., and therefore, the mechanical properties such as tensile strength and the elongation were degraded. In comparative example 2, the reducing temperature was as low as 500° C., and therefore, the coating adherence was inadequate.

In the case of comparative example 3, the intermediate rapid cooling temperature was 200° C., and therefore, the w

TABLE 1

| Classification | Intermediate rapid cooling rate (° C./min) | Intermediate rapid cooling temperature (° C.) | Scale composition (wt %) FeO | $Fe_3O_4$ | $Fe_2O_3$ | Time consumed in reducing to 60%-pure iron (sec) |
|---|---|---|---|---|---|---|
| Inventive example 1 | 20 | 300 | 37.9 | 47.1 | 15.0 | 117 |
| Inventive example 2 | 20 | 400 | 42.1 | 35.2 | 22.7 | 111 |
| Inventive example 3 | 50 | 400 | 70.6 | 21.4 | 8.0 | 102 |
| Inventive example 4 | 100 | 470 | 100 | 0 | 0 | 89 |
| Conventional example 1 | 6 | — | 6.1 | 81.3 | 12.6 | 250 |

üstite component was less than 20%. Therefore, the reduction required a long period of time, and therefore, the reduction was incomplete within the given time period, thereby making it impossible to obtain superior coating adherence.

In the comparative examples 4–6, the wüstite component was 20% or more, and the heat treating conditions were same as the inventive examples. Notwithstanding these similarities, the coating adherences were insufficient. The reason is as follows. That is, the intermediate rapid cooling temperature was 400° C., and thus, owing to the thermal strain during cooling, peelings were liable to occur.

TABLE 2

| Classification | Intermediate cooling rate (° C./min) | Intermediate cooling temperature (° C.) | FeO amount (wt %) | Reducing conditions: $H_2$ gas amount (%) | Reducing conditions: Reducing temperature (° C.) | Coating adherence: 0.2 wt % | 0.3 wt % | 1.0 wt % | 3.0 wt % | 5.0 wt % |
|---|---|---|---|---|---|---|---|---|---|---|
| Inventive example | | | | | | | | | | |
| 1 | 10 | 300 | 21.3 | 20 | 700 | ○ | ○ | ○ | ○ | ○ |
| 2 | | | | | 550 | Δ | ○ | ○ | ○ | ○ |
| 3 | | 500 | 23.4 | 30 | 700 | ○ | ○ | ○ | ○ | ○ |
| 4 | | | | | 550 | Δ | ○ | ○ | ○ | ○ |
| 5 | 20 | 300 | 37.9 | 20 | 700 | ○ | ○ | ○ | ○ | ○ |
| 6 | | | | | 650 | ○ | ○ | ○ | ○ | ○ |
| 7 | | | | | 550 | Δ | ○ | ○ | ○ | ○ |
| 8 | | 400 | 42.1 | | 700 | ○ | ○ | ○ | ○ | ○ |
| 9 | | | | | 650 | ○ | ○ | ○ | ○ | ○ |
| 10 | | | | | 550 | Δ | ○ | ○ | ○ | ○ |
| 11 | | 500 | 45.0 | | 700 | ○ | ○ | ○ | ○ | ○ |
| 12 | | | | | 650 | ○ | ○ | ○ | ○ | ○ |
| 13 | | | | | 550 | Δ | ○ | ○ | ○ | ○ |
| 14 | 100 | 400 | 30.3 | 20 | 700 | ○ | ○ | ○ | ○ | ○ |
| 15 | | | | | 550 | Δ | ○ | ○ | ○ | ○ |
| 16 | 300 | 450 | 52.4 | 20 | 700 | ○ | ○ | ○ | ○ | ○ |
| 17 | | | | | 550 | Δ | ○ | ○ | ○ | ○ |
| Comparative example | | | | | | | | | | |
| 1 | 20 | 400 | 42.1 | 20 | 750 | ○ | ○ | ○ | ○ | ○ |
| 2 | | | | | 500 | X | X | X | X | X |
| 3 | 300 | 200 | 18.7 | | 550 | X | X | X | X | X |
| 4 | 400 | 300 | 54.1 | | 700 | X | X | X | X | X |
| 5 | | 400 | 63.1 | | 600 | X | X | X | X | X |
| 6 | | 500 | 65.7 | | 500 | X | X | X | X | X |

As can be seen in Table 2 above, in the cases of inventive examples 1–17, if the reducing heat-treatment temperature was 550° C., the levels of the coating adherence were closely related to the Al contents within the zinc bath. That is, when the reducing heat-treatment temperature was 550° C., if the Al content was 0.2 wt %, the coating adherence may be imperfect. However, if the Al content was 0.3–5.0 wt %, then all of them showed superior coating adherences. This is due to the fact that the molten Al forms an Fe—Al compound or Fe—Zn—Al compounds on the boundary between the matrix structure and the scale layer to quickly form a thin alloy film. Thus, the formation of highly brittle Fe—Zn compounds is inhibited. This action becomes more brisk according as the Al content is raised to 0.3 wt %, with the result that the reducing heat-treatment range is expanded at the lower limit.

EXAMPLE 3

In order to manufacture hot rolled galvanized steel sheets with an Si content of 0.1 wt % or more according to the present invention, steel having the composition of Table 3 was hot-rolled into sheets. Then the sheets were subjected to an intermediate rapid cooling at a cooling rate of 20° C./min to an intermediate rapid cooling temperature range of 200–500° C., thereby obtaining steel sheets with various wüstite components.

TABLE 3

| Classification | C | Mn | Si | P | S | Cr | Ni | Cu | Sol.Al |
|---|---|---|---|---|---|---|---|---|---|
| Si-C steel | 0.092 | 0.39 | 0.35 | 0.81 | 0.006 | 0.042 | 0.016 | 0.27 | 0.029 |

Then the Si-containing hot rolled steel sheets thus obtained (SPA-H) were formed into a size of 100 mm×200 mm×1.2 mm. Then the scales were reduced by using a coating simulator (made by Rhesca company) under a hydrogen concentration of 30% at a reducing heat-treatment temperature of 550–850° C. After the reduction, the steel sheets were dipped into a zinc bath which was maintained at 450° C. with an Al content of 0.2 wt %, to carry out the hot dipping. Then the coating adherences were measured, and the measured results are shown in Table 4 below. In order to measure the coating adherences, 180° bending tests were carried out by using a bending tester. Then a tape was attached on each of the steel sheets, and removed by pulling it. During the removal of the tapes, the peeling degrees of the coating layer could be evaluated. In Table 4 below, X indicates a complete peeling, and 0 indicates a good adherence.

Figure 5:
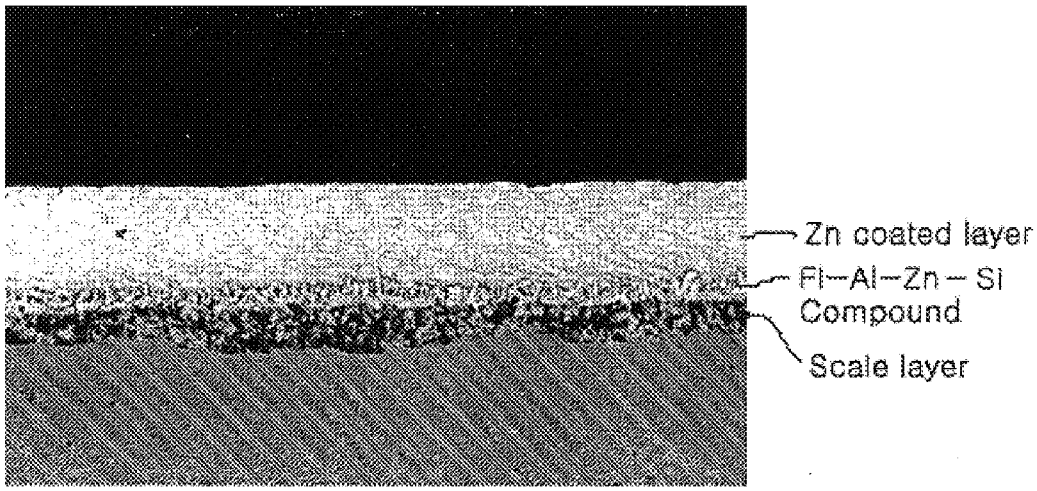
FIG. 5 is a Photomicrograph at 1000× magnification showing the microstructure of the coating layer of the hot rolled galvanized steel sheet with an Si content of 0.1 wt % or more manufactured by the present invention.

As shown in Table 4 below, the inventive examples 1–6 showed a superior coating adherence under the given reducing heat-treatment conditions. That is, as illustrated in the coating structure photograph of FIG. 5, the molten Al of the zinc bath reacted with the fayalite compounds which are present on the boundary between the matrix structure and the scale layer, to form Fe—Al—Zn—Si compounds, thereby firmly coupling the d layer to the matrix structure.

TABLE 4

| Classification | Intermediate rapid cooling rate (min/° C.) | Intermediate rapid cooling temperature (° C.) | Heat treating conditions: Hydrogen concentration (%) | Heat treating conditions: Reducing temperature (° C.) | Heat treating conditions: Reducing time (sec) | Tensile strength (Kg/mm$^2$) | Coating adherence |
|---|---|---|---|---|---|---|---|
| Inventive example | | | | | | | |
| 1 | 20 | 500 | 30 | 650 | 60 | 50.9 | ○ |
| 2 | | 400 | | | 250 | 50.1 | ○ |
| 3 | | 300 | | | 400 | 49.8 | ○ |
| 4 | | 500 | | 750 | 60 | 50.5 | ○ |
| 5 | | 400 | | | 250 | 49.5 | ○ |
| 6 | | 300 | | | 400 | 49.2 | ○ |
| Comparative example | | | | | | | |
| 1 | | 500 | | 550 | 60 | 51.3 | X |
| 2 | | 400 | | | 120 | 50.8 | X |
| 3 | | 300 | | | 250 | 50.9 | X |
| 4 | | 400 | | | 400 | 50.6 | X |
| 5 | | 200 | | 650 | 400 | 50.1 | X |
| 6 | | 300 | | 850 | 400 | 47.5 | ○ |

Meanwhile, in the comparative examples 1–4, the reducing heat-treatment temperature was as low as 550° C., and therefore, the scales could not be sufficiently reduced, with the result that the coating adherence was aggravated.

In the comparative example 5, the reducing heat-treatment temperature was properly 650° C., but the intermediate rapid cooling temperature was as low as 200° C., with the result that the wüstite of the scale composition was less than 20%. Therefore, under the given reducing conditions, the scales could not be sufficiently reduced, thereby aggravating the coating adherence.

The comparative example 6 showed a good coating adherence, but the reducing heat-treatment temperature was as high as 850° C., with the result that the tensile strength was degraded as shown in Table 4 above.

According to the present invention as described above, the scale composition of the hot rolled steel sheet is controlled such that the wüstite amount should be 20% or more, and the Al content in the zinc bath is optimized. Thus the productivity and the coating adherence are greatly improved.

What is claimed is:

1. A method for manufacturing a hot rolled galvanized steel at a sheet at a high speed, said method not including a pickling step, comprising the steps of:

cooling a hot rolled sheet and cooling it at a temperature of above 570° C.;

carrying out an intermediate rapid cooling on said hot rolled and coiled steel sheet to an intermediate temperature of 300–500° C. at a rate such that 20% or more of any scales present in said sheet are of wüsitie, carrying out a reducing heat treatment at a temperature of 550–700° C. for 30–300 seconds under at least a 20% hydrogen atmosphere; and dipping said hot rolled and reduced steel sheet into a zinc bath having an Al content of 0.2–5.0 wt %, whereby a superior coating adherence and a superior productivity are realized.

2. The method as claimed in claim 1, wherein said coiled hot rolled steel sheet is subjected to said intermediate cooling at a cooling rate of 10–300° C./min.

3. The method as claimed in claim 2, wherein the Al content of said zinc bath is 0.3–5.0 wt %.

4. The method as claimed in claim 1, wherein the Al content of said zinc bath is 0.3–5.0 wt %.

5. The method for manufacturing a hot rolled galvanized steel sheet at a high speed, said method not including a pickling step and with 0.1 wt % or more of Si contained therein, comprising the steps of:

cooling a hot rolled steel sheet and coiling it at a temperature of above 570° C.;

carrying out an intermediate rapid cooling on said hot rolled and coiled steel sheet to an intermediate tem perature of 300–500° C. at a rate such that 20% or more of any scales present in said are of wüsitie, carrying out a reducing heat treatment at a temperature of 650–750° C. for 60–400 seconds under at least a 30% hydrogen atmosphere; and dipping said hot rolled and reduced steel sheet into a zinc bath having an Al content of 0.2–5.0 wt %, whereby a superior coating adherence and a superior productivity are realized.

6. The method as claimed in claim 5, wherein said coiled hot rolled steel sheet is subjected to said intermediate cooling at a cooling rate of 10–300° C./min.

7. The method as claimed in claim 6, wherein the Al content of said zinc bath is 0.3–5.0 wt %.

8. The method as claimed in claim 5, wherein the Al content of said zinc bath is 0.3–5.0 wt %.

* * * * *

UNITED STATES PATENT AND TRADEMARK OFFICE

CERTIFICATE OF CORRECTION

PATENT NO. : 6,258,186 B1
DATED : July 10, 2001
INVENTOR(S) : Jin Won Choi

It is certified that error appears in the above-identified patent and that said Letters Patent is hereby corrected as shown below:

Column 1,
Lines 13-14, "w üstite" should read -- wüstite --.
Line 26, "pickling stop" should read -- pickling step --.
Line 43, "the zinic coating" swhould read -- the zinc coating --.

Column 4,
Line 44, "picking step" should read -- pickling step --.
Lines 52-53, "w üstite" should read -- wüstite --.

Column 5,
Lines 26-27, "w üstite" should read -- wüstite --.

Column 8,
Line 47 to Column 9, line 1, "w üstite" should read -- wüstite --.

Column 10,
Lines 53-54, "w üstite" should read -- wüstite --.

Column 12, claim 1,
Line 8, "steel at a sheet" should read -- steel sheet --.

Column 12,
Line 67 to Column 13, claim 5, line 1,"tem perature" should read -- temperature --.

Column 13, claim 5,
Line 2, after "in said are" should read -- in said sheet are --.

Signed and Sealed this

Twenty-sixth Day of March, 2002

*Attest:*

*Attesting Officer*

JAMES E. ROGAN
*Director of the United States Patent and Trademark Office*